US006286320B1

(12) United States Patent
Riche et al.

(10) Patent No.: US 6,286,320 B1
(45) Date of Patent: Sep. 11, 2001

(54) BOTTOM ENTRY PUMPING SYSTEM WITH TERTIARY CONTAINMENT

(75) Inventors: Ali I. Riche; Ned P. Baudat, both of Sugar Land, TX (US)

(73) Assignee: Phillips Petroleum Company, Bartlesville, OK (US)

( * ) Notice: Subject to any disclaimer, the term of this patent is extended or adjusted under 35 U.S.C. 154(b) by 0 days.

(21) Appl. No.: 09/492,631

(22) Filed: Jan. 27, 2000

Related U.S. Application Data

(60) Provisional application No. 60/117,954, filed on Jan. 29, 1999.

(51) Int. Cl.[7] ..... F17C 13/00; F17C 1/00

(52) U.S. Cl. ..... 62/50.6; 62/50.7; 62/53.1

(58) Field of Search ..... 62/50.6, 45.1, 62/50.7, 53.1

(56) References Cited

U.S. PATENT DOCUMENTS 2,386,958 10/1945 Jackson .
4,920,754 5/1990 Dederer et al. .
5,762,119 6/1998 Platz et al. .
5,954,101 * 9/1999 Drube et al. ..... 141/82

FOREIGN PATENT DOCUMENTS 2 020 542 4/1970 (DE) .
59147198 8/1984 (JP) .

* cited by examiner

*Primary Examiner*—William Doerrler
(74) *Attorney, Agent, or Firm*—Gary L Haag

(57) ABSTRACT

A bottom entry pumping system for liquids, particularly cryogenic liquids, is described which includes a container with an outer wall, which may be concrete and/or metal, and an optional inner metal liner. A line is provided for transporting liquid from a liquid storage tank into the container via a pump connected to the line. The line may be optionally vacuum-jacketed. There is also provided at least one cryogenic valve in the line which can be controlled from outside the container. While pumping liquified natural gas (LNG) is an expected use of the invention, pumping other cryogenic liquids and even other non-cryogenic liquids may be performed with the invention. It is anticipated that the bottom entry pumping system of the invention will meet NFPA 59A requirements in the full containment embodiment.

20 Claims, 1 Drawing Sheet

BOTTOM ENTRY PUMPING SYSTEM WITH TERTIARY CONTAINMENT

This application claims benefit of provisional No. 60/117,954 filed Jan. 29, 1999.

FIELD OF THE INVENTION

The present invention relates to methods and structures for pumping liquids to and from a tank, and in a further embodiment relates to methods and structures for pumping liquids from a tank at cryogenic temperatures.

BACKGROUND OF THE INVENTION

Conventionally, liquified natural gas (LNG) is pumped to and from a tank via a pump which has been positioned within the bottom of the tank up through a pipe to the top of the tank to a relatively expensive, complex and sizable piping and handling system that is built at considerable expense on top of the LNG tank.

It is desirable to reduce the cost, complexity, size and construction time for a system used to pump LNG to and from its storage tank.

SUMMARY OF THE INVENTION

Accordingly, it is an object of the present invention to provide a simplified method and apparatus for pumping liquids to and from a storage tank.

Another object of the present invention is to provide a simplified method and apparatus for pumping cryogenic liquids such as LNG to and from a storage tank safely.

Still another object of the invention is to provide an apparatus for pumping cryogenic liquids such as LNG to and from a storage tank safely, and more simply and less complexly than currently done, and which can be built relatively more quickly.

In carrying out these and other objects of the invention, there is provided, in one form, a bottom entry pumping system for cryogenic liquids which includes a container which has an outer wall, which may be concrete and/or metal (e.g. stainless or carbon steel), and an optional inner metal liner, where the metal is rated for cryogenic temperatures. The system also has a line for transporting liquid from a liquid storage tank through the container, and a pump connected to the line for pumping liquid out of the liquid storage tank. Optionally, this line is vacuum-jacketed. The system also includes at least one cryogenic valve in the line which can be controlled from outside the container.

In the case where an optional inner metal liner is not used, powdered perlite (eutectic between ferite and cementite) can be used to fill the voids between the outer wall and the equipment. Another optional feature is to provide earthen dikes or berms in place around the bottom entry pumping system for further containment.

Figure 1:
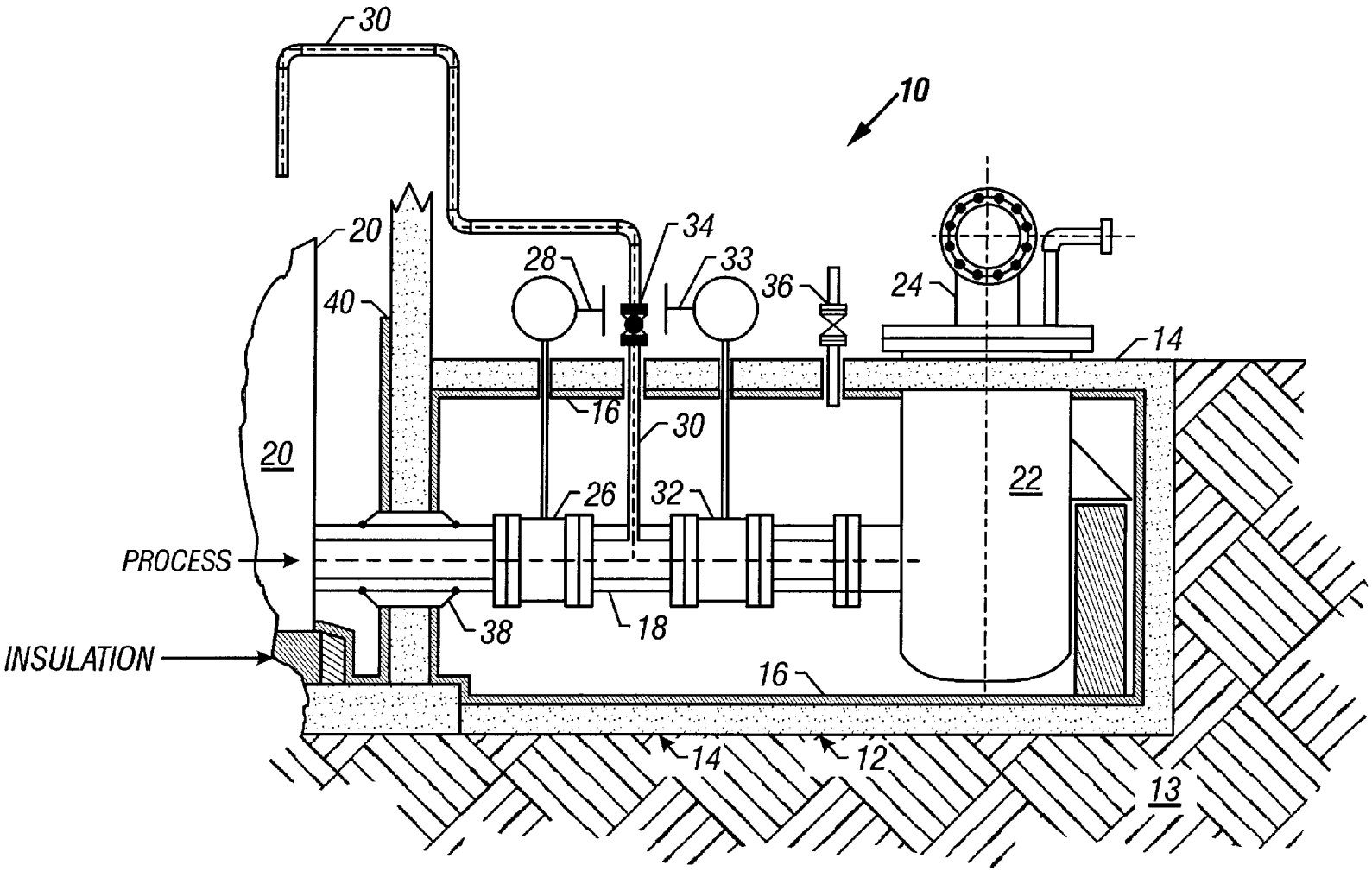
FIG. 1 is a schematic representation of the bottom entry pumping system of this invention.

It will be appreciated that the FIGURE is not to scale or proportion as it is simply a schematic for illustration purposes.

DETAILED DESCRIPTION OF THE INVENTION

The invention herein employs a bottom entry pumping system for liquified natural gas (LNG) tanks in lieu of the traditional top entry pumping system, which typically requires complex piping on the tank roof. The fundamental principle of this invention is to reduce the cost associated with the traditional top entry pumping system, and also to reduce the construction schedule and delay costs associated with building a mammoth piping and handling system on top of the tanks.

It will be appreciated that the bottom entry pumping system could be employed advantageously for any liquid, particularly any cryogenic liquid, LNG being simply one example. Cryogenic is defined in its normal meaning as concerning any liquid at a temperature below −100° F. (−73° C.). This definition of course includes, but is not limited to, other liquified gases including, but not necessarily limited to, oxygen, nitrogen, hydrogen, hydrocarbon gases (e.g. methane and the like) at temperatures of approximately −260° F. (−162° C.).

The inventive bottom entry pumping system utilizes a simplified design concept for bottom entry piping to an LNG pump, for example. The piping system and the LNG pump will be contained in a concrete container or box with an optional stainless steel liner, e.g. to form a full containment design integral with the tank for the piping and the pump. If less than full containment is desired, the invention can be practiced in an embodiment without an inner liner. The container wall may thus be constructed of stainless steel, carbon steel, concrete, or a combination thereof.

- The piping system may optionally utilize vacuum-jacketed pipe not used in prior LNG pumping service.
- Cryogenic valves with extended bonnets and actuators or the like will be located outside the concrete container or box.
- A cryogenic pump to handle the LNG, e.g., will have maintenance access outside the concrete box (on the top as shown in FIG. 1).
- A stainless steel sleeve (or other suitable metal) will be seal welded to the tank inner liner and the concrete box liner and the outer jacket of the vacuum-jacketed pipe, if present, to form double containment for the LNG.
- A separate box or container may be provided for each pump which will facilitate maintenance.
- The concrete box or container may be provided with a nitrogen purge system to remove any hydrocarbon or other flammable vapor from the container.
- The box or container will be provided with maintenance access to maintain equipment inside the box or container.

More particularly referring to FIG. 1, the bottom entry pumping system generally referred to as 10 includes a container 12 optionally placed into the earth 13, which container 12 has at least an outer concrete wall 14 and an optional inner metal liner 16. Where the bottom entry pumping system 10 is designed and built to pump cryogenic liquids, e.g. LNG, the inner metal liner 16, if present, should be rated for the cryogenic temperatures expected. In a non-limiting example, the inner metal liner 16 may be made of metals including, but not necessarily limited to, stainless steel, 9% nickel iron or any other material rated for cryogenic temperatures and combinations thereof.

Also present in the bottom entry pumping system 10 is a line 18, optionally vacuum-jacketed, for transporting liquid from a liquid storage tank 20 through the container 12. A pump 22 is connected to the vacuum-jacketed line 18 for pumping liquid out of the liquid storage tank 20 via pump line 24. There is also provided at least one first cryogenic valve 26 in the vacuum-jacketed line 18 which can be controlled from outside the container 12. In a non-limiting example, cryogenic valve 26 is a butterfly valve with extended bonnet 28 or other actuator.

It is expected that the optionally vacuum-jacketed line 18 joins the liquid storage tank 20 near the bottom of the tank 20. By "near the bottom of the tank 20", it is meant as close to the bottom as practical up to a distance or height where it would be impractical or unwise to have such a connection made.

The bottom entry pumping system 10 may further include an equalizing vent line 30 in the vacuum-jacketed line 18 to the liquid storage tank 20 for venting LNG back to the tank 20 or equalizing pressures therein. In this case there is provided a second cryogenic valve 32 with extended control bonnet 33 (or other actuator) in the vacuum-jacketed line 18 between the equalizing vent line 30 and the pump 22. The equalizing vent line 30 will typically be provided with a valve 34.

Container 12 may also be provided with an inert gas purge line 36 to permit the container to be purged with an inert gas such as nitrogen or the like in a non-limiting example.

In most cases, it is expected to be desirable to provide a sleeve 38 around the vacuum-jacketed line 18 where the line enters the container 12 from the tank 20. The sleeve 38 may also be made of a metal rated for cryogenic temperatures, as described above. The stainless steel sleeve 38 (or other suitable metal) will be seal welded to the tank metal inner liner 40 and the inner metal liner 16 and the outer jacket of the vacuum-jacketed pipe 18 to form at least double containment for the LNG, or other cryogenic liquid, in one non-limiting embodiment.

It is anticipated that in some embodiments a separate box or container 12 may be provided for each pump 22 for the tank 20 which will facilitate maintenance and isolation of the equipment. Alternatively, it may be desirable to place more than one pump 22 in a container 12 in some instances.

It is believed that the inventive design will reduce cost and schedule time for installation of the pumping system. For example, it is estimated that the cost savings will range between two and five million dollars per tank, although, of course, this will depend on the size of the tank and the number and size of the pumps required and specified. It is also expected that this invention will provide a bottom entry pumping system which will meet National Fire Protection Agency (NFPA) 59A requirements in the full containment embodiment (which includes the inner metal liner 16). If full containment is not required, the design can be further optimized and reduced in complexity by elimination of the inner metal liner. Perlite may be optionally used to fill the space between the equipment and the outer wall 14, in the event no inner metal liner 16 is employed. Perlite may also be used to fill the space between the equipment and inner metal liner 16, when present, if desired. In one preferred, optional embodiment, both a perlite fill and an inert gas purge may be used together. In another, optional feature, earthen dikes or berms (not shown) may be put in place around the bottom entry pumping system 10 for further containment.

In the full, tertiary containment embodiment, the liquid being pumped is contained by at least three barriers: (1) the optional vacuum-jacketed line 18, (2) the inner metal liner 16, and (3) the concrete walls 14 of the container 12. The method and apparatus of this invention are expected to reduce cost and schedule time for constructing LNG pumping systems, particularly with the advantage of permitting construction on grade level.

In the foregoing specification, the invention has been described with reference to specific embodiments thereof, and has been demonstrated as effective in providing structures and procedures for pumping liquids, particularly cryogenic liquids, from a storage tank. However, it will be evident that various modifications and changes can be made thereto without departing from the broader spirit or scope of the invention as set forth in the appended claims. Accordingly, the specification is to be regarded in an illustrative rather than a restrictive sense. For example, there may be other ways of configuring and/or operating the bottom entry pumping system differently from those explicitly described and shown herein which nevertheless fall within the scope of the claims. In an additional instance, a different valve control mechanism other than cryogenic butterfly valves with extended bonnets may be used.

We claim:

1. A bottom entry pumping system for cryogenic liquids comprising:

a container including an outer wall made of a material selected from the group consisting of concrete, stainless steel, carbon steel, and combinations thereof, where the container is at least partially surrounded by earth for additional containment;

a line for transporting liquid to or from a liquid storage tank through the container;

a pump connected to the line for pumping liquid into or out of the liquid storage tank; and at least one cryogenic valve in the line which can be controlled from outside the container.

2. The bottom entry pumping system of claim 1 further comprising an equalizing vent line from the line to the liquid storage tank, and further comprising at least a first cryogenic valve in the line between the liquid storage tank and the equalizing vent line, and at least a second cryogenic valve in the line between the equalizing vent line and the pump.

3. The bottom entry pumping system of claim 2 further comprising a valve in the equalizing vent line.

4. The bottom entry pumping system of claim 1 further comprising a sleeve around the line where the line enters the container from the tank, the sleeve is made of a metal rated for cryogenic temperatures, and where the sleeve is welded to the inner metal liner and the line.

5. The bottom entry pumping system of claim 4 where the metal of the sleeve is stainless steel.

6. The bottom entry pumping system of claim 1 where the liquid in the liquid storage tank is liquified natural gas (LNG).

7. The bottom entry pumping system of claim 1 where the line joins the liquid storage tank near the bottom thereof.

8. The bottom entry pumping system of claim 1 where the line is vacuum-jacketed along at least part of its length.

9. A method for pumping a cryogenic liquid comprising:

providing a bottom entry pumping system including:

a container including an outer wall made of a material selected from the group consisting of concrete, stainless steel, carbon steel, and combinations thereof, where the container is at least partially surrounded by earth;

a line for transporting liquid to or from a liquid storage tank through the container;

a pump connected to the line for pumping liquid into or out of the liquid storage tank; and at least one cryogenic valve in the line which can be controlled from outside the container; and pumping liquid into or out of the liquid storage tank through the line using the pump.

10. The method of claim 9 where in providing the bottom entry pumping system, the system further comprises an equalizing vent line from the line to the liquid storage tank, and further comprising at least a first cryogenic valve in the line between the liquid storage tank and the equalizing vent line, and at least a second cryogenic valve in the line between the equalizing vent line and the pump.

11. The method of claim 10 where in providing the bottom entry pumping system the system, further comprises a valve in the equalizing vent line.

12. The method of claim 9 where in providing the bottom entry pumping system, the system further comprises a sleeve around the line where the line enters the container from the tank, the sleeve is made of a metal rated for cryogenic temperatures, and where the sleeve is welded to the inner metal liner and the line.

13. The method of claim 12 where in providing the bottom entry pumping system, the metal of the sleeve is stainless steel.

14. The method of claim 9 where the liquid is liquified natural gas (LNG).

15. The method of claim 9 where in providing the bottom entry pumping system, the line joins the liquid storage tank near the bottom thereof.

16. The method of claim 9 where in providing the bottom entry pumping system, the line is vacuum-jacketed along at least part of its length.

17. A bottom entry pumping system for cryogenic liquids comprising:

a container including an outer wall made of a material selected from the group consisting of concrete, stainless steel, carbon steel, and combinations thereof, where the container additionally includes an inner liner, where the liner is made of a metal rated for cryogenic temperatures;

a line for transporting liquid to or from a liquid storage tank through the container;

a pump connected to the line for pumping liquid into or out of the liquid storage tank; and at least one cryogenic valve in the line which can be controlled from outside the container.

18. A bottom entry pumping system for cryogenic liquids comprising:

a container including an outer wall made of a material selected from the group consisting of concrete, stainless steel, carbon steel, and combinations thereof;

a line for transporting liquid to or from a liquid storage tank through the container;

a pump connected to the line for pumping liquid into or out of the liquid storage tank;

at least one cryogenic valve in the line which can be controlled from outside the container; and an inert gas purge line in the container to permit the container to be purged with an inert gas.

19. A method for pumping a cryogenic liquid comprising:

providing a bottom entry pumping system including:

a container including an outer wall made of a material selected from the group consisting of concrete, stainless steel, carbon steel, and combinations thereof;

a line for transporting liquid to or from a liquid storage tank through the container;

a pump connected to the line for pumping liquid into or out of the liquid storage tank;

at least one cryogenic valve in the line which can be controlled from outside the container; and an inert gas purge line in the container to permit the container to be purged with an inert gas; and pumping liquid into or out of the liquid storage tank through the line using the pump.

20. A method for pumping a cryogenic liquid comprising:

providing a bottom entry pumping system including:

a container including an outer wall made of a material selected from the group consisting of concrete, stainless steel, carbon steel, and combinations thereof, where the container further includes an inner liner, where the liner is made of a metal rated for cryogenic temperatures;

a line for transporting liquid to or from a liquid storage tank through the container;

a pump connected to the line for pumping liquid into or out of the liquid storage tank; and at least one cryogenic valve in the line which can be controlled from outside the container; and pumping liquid into or out of the liquid storage tank through the line using the pump.

* * * * *